United States Patent [19]

Muis et al.

[11] 4,412,487

[45] Nov. 1, 1983

[54] APPARATUS FOR MANUFACTURING A PRINTED PLASTIC ARTICLE

[75] Inventors: Roelof Muis, Vroomshoop; Kornelis Herder, Goor, both of Netherlands

[73] Assignee: Wavin B.V., Netherlands

[21] Appl. No.: 221,305

[22] Filed: Dec. 30, 1980

[30] Foreign Application Priority Data

Jan. 8, 1980 [NL] Netherlands ..... 8000104

[51] Int. Cl.[3] ..... B41F 17/00

[52] U.S. Cl. ..... 101/41; 101/379; 118/211; 156/493; 427/284

[58] Field of Search ..... 101/41, 44, 35, 9, 10, 101/11, 379; 118/211; 156/493, 488, 196, 212; 427/284, 285

[56] References Cited

U.S. PATENT DOCUMENTS

| | | | |
|---|---|---|---|
| 1,026,790 | 5/1912 | Douglass | 101/44 X |
| 1,069,356 | 8/1913 | Tilden | 101/379 X |
| 1,992,037 | 2/1935 | Mulder | 101/379 |
| 2,105,400 | 1/1938 | Booth | 101/35 |
| 2,124,711 | 7/1938 | Rowell | 101/41 |
| 2,202,464 | 5/1940 | Pattison | 101/41 X |
| 2,202,465 | 5/1940 | Pattison | 101/41 |
| 2,419,758 | 4/1947 | Borkland | 156/493 X |
| 2,493,953 | 1/1950 | Emerson | 101/41 |
| 2,621,591 | 12/1952 | Henderson | 101/379 |
| 2,751,701 | 6/1956 | Grupe | 156/238 |
| 2,787,950 | 4/1957 | Dorsch | 101/44 |
| 3,187,666 | 6/1965 | Pedroli | 101/44 |
| 3,732,807 | 5/1973 | Robertson | 101/11 |
| 3,756,165 | 9/1973 | Valiela | 101/41 X |

FOREIGN PATENT DOCUMENTS

| | | | |
|---|---|---|---|
| 928569 | 6/1973 | Canada . | |
| 6713115 | 3/1969 | Netherlands | 101/35 |

OTHER PUBLICATIONS

Article entitled "Hot Foil Printing" from *International Plastics Engineering*, 1, (1961,10), 9 by S. F. Lott, pp. 474–475.

*Primary Examiner*—Clifford D. Crowder
*Attorney, Agent, or Firm*—Wigman & Cohen

[57] ABSTRACT

The raised edge part of a deep-drawn plastic cover is printed by pressing a carrier of a resilient deformable material, carrying a coloring composition, against the raised edge part.

An apparatus for manufacturing the plastic cover comprises a deformable carrier for carrying a coloring composition. The carrier is integral with a cylindrical part connected with a first cylinder. Two concentric cylinders, positioned around the first cylinder at either side thereof, deform annular parts of resilient material and press these annular parts against the raised edge part when, on the one hand, the first cylinder and, on the other hand, the two concentric cylinders are moved with respect to each other.

The coloring composition may also be carried by a layer-shaped carrier material.

4 Claims, 4 Drawing Figures

APPARATUS FOR MANUFACTURING A PRINTED PLASTIC ARTICLE

BACKGROUND OF THE INVENTION

1. Field of the Invention

The present invention relates to a method for manufacturing a printed plastic article, more particularly a plastic cover, comprising a flat surface and a raised edge part adjoining said flat surface. The flat surface is provided with apertures, such as in a tray, but also with surfaces which are slightly bent.

2. Description of the Prior Art

A method for manufacturing printed plastic articles, such as covers, has been used in the art. In this known method printed foil is subsequently deformed by deep-drawing.

A considerable disadvantage of this method is that an irregularly printed cover is obtained, especially if polypropylene is used as an initial material for manufacturing a cover.

Another disadvantage is that a rather large quantity of waste material is obtained after having stamped the respective cover, which printed waste material cannot be recycled to the plastic feed material used for forming a foil to be shaped into the cover.

SUMMARY OF THE INVENTION

In view of the foregoing factors and conditions of the prior art, it is a primary object of the present invention to provide a method in which the aforementioned disadvantages are eliminated.

This object is attained in accordance with the invention in that at least the raised edge part is printed by directly or indirectly pressing a carrier carrying a coloring composition against said raised edge part.

By using the latter measure, first a cover can be formed and stamped from a normal non-printed foil. This implies that the waste material obtained can be recycled without any problems. After the printing procedure, an excellently printed cover is obtained. This is inherent with the fact that the printing to be performed can also be accurately applied upon the raised edge part, which is not always possible if a pre-printed foil is used.

The carrier carrying the coloring composition advantageously consists of a resilient deformable material, which will engage the aforementioned raised edge part if subjected to a pressure.

By means of, for example, a body consisting of a strongly deformable resilient material carrying a coloring composition, an excellent printing of the raised edge part of a cover is thus obtained.

The carrier carrying the coloring composition advantageously consists of a thin layer-shaped carrier being pressed against the raised edge part.

The present invention also relates to an apparatus for manufacturing a printed plastic article, more particularly a cover comprising a flat surface, whether or not provided with apertures, and a raised edge part adjoining the flat surface. The apparatus comprises a device for printing the plastic article. The apparatus also comprises a deformable carrier for carrying a coloring composition and at least one member for pressing the deformable carrier against the raised edge part.

In a preferred embodiment, the present apparatus comprises a first cylinder being connected with a resilient body and another part comprising two concentrically positioned cylinders, at either side of the first cylinder. The concentric cylinders cooperate with annular parts of the resilient deformable body in such a manner that the annular parts of the body can be moved around the raised edge part.

Other attendant advantages will be more readily appreciated as the present invention becomes better understood by reference to the following detailed description considered in connection with the accompanying drawings in which like reference symbols designate like parts throughout the figures.

DESCRIPTION OF A PREFERRED EMBODIMENT

Figure 1:
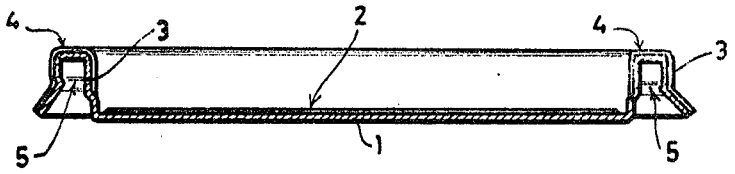
FIG. 1 is a cross section of a printed cover of polypropylene, obtained according to the method of the present invention.

In FIG. 1 a polypropylene cover comprises a round flat surface 1, provided with a printing 2 (for example in the color yellow), the raised edge part 3 being provided with a printing 4 in a different color.

Due to the presence of the raised edge part 3, a groove is obtained, which can engage a rim of a container, in order to close off said container.

Up until now a foil of polypropylene was pre-printed with a printing 2, and a printing 4, whereupon the covers were formed by deep-drawing. This resulted, however, in very irregularly printed covers. Moreover, waste material could not be recycled to the plastic to be used for forming the covers.

The present invention aims to provide a solution for this problem.

In the method according to the present invention, an initial transparent polypropylene foil is deformed by deep-drawing, thereby forming the flat cover surface 1 and the raised edge part 3.

The flat surface part 1 may be provided in one and the same action with the printing 2 by means of, e.g., a stamp.

Figure 2:
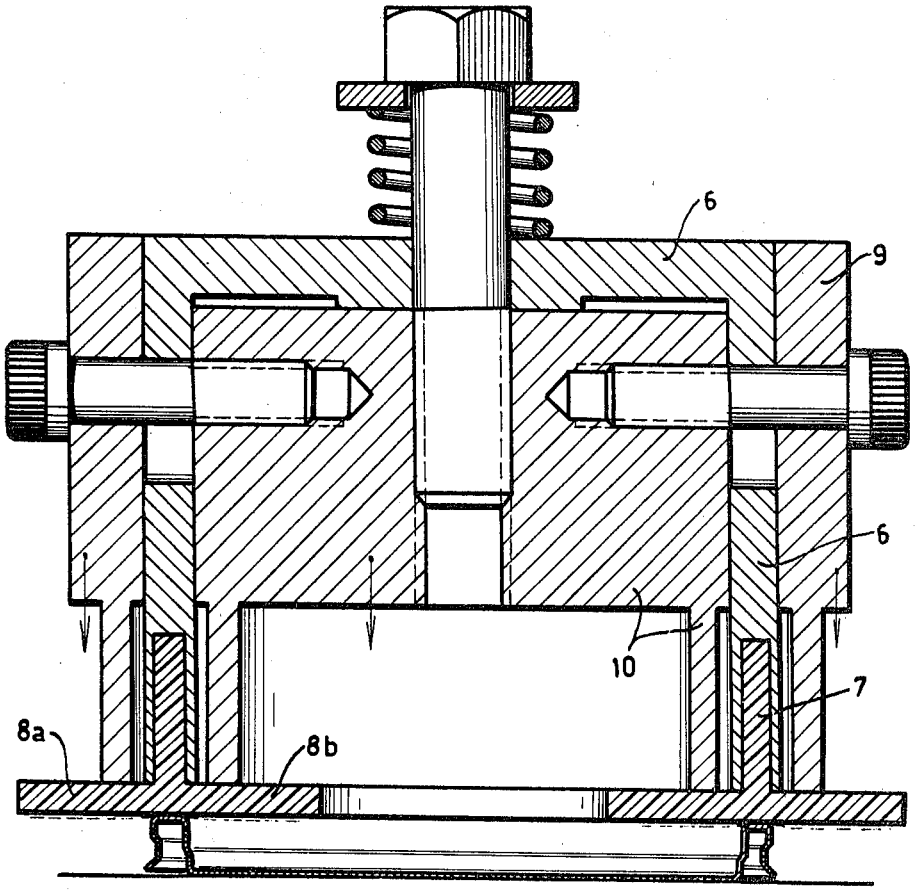
FIG. 2 is an embodiment of a first apparatus for printing a raised edge part of a cover.

Referring now to FIG. 2, for printing the raised edge part 3, an apparatus is used comprising a first stationary cylinder 6, being integral with a cylindrical part 7 of a resilient deformable body (such as rubber or foam plastic). Said cylindrical part 7 is integral with a substantially flat one-piece annular plate, consisting of an outer part 8*a*, and inner part 8*b*.

The apparatus further comprises an outer cylinder 9 and an inner cylinder 10, which cylinders 9 and 10 may be moved downwardly, while deforming the annular parts 8*a* and 8*b* of the resilient body, so that the raised edge part 3 can be printed in an excellent manner.

Figure 3:
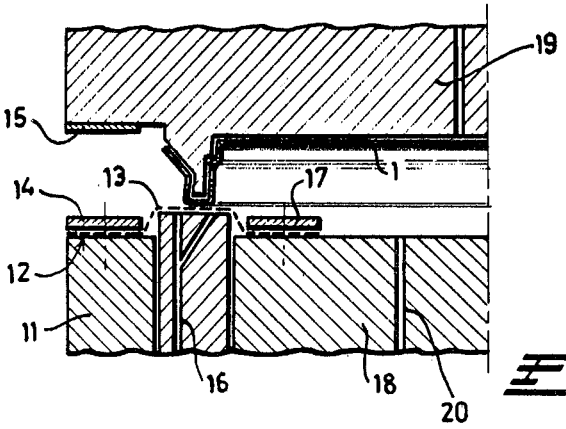
FIG. 3 is another apparatus for printing a raised edge part of a cover, shown prior to the position in which the printing occurs.
Figure 4:
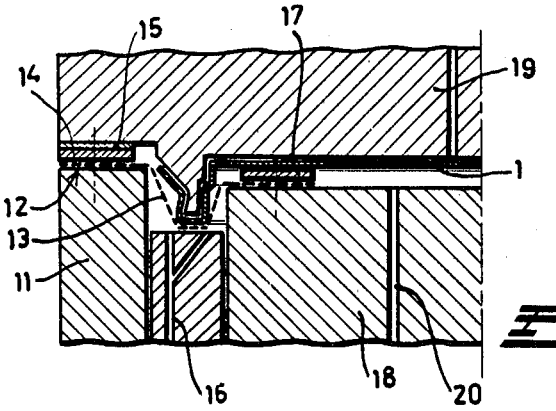
FIG. 4 is an apparatus corresponding to that of FIG. 3, said apparatus shown in the printing position.

In FIGS. 3 and 4, a modified apparatus for printing preshaped covers is used. The flat surface 1 of a cover is arranged upon a retaining member 19. As can be seen, this apparatus comprises a cylinder 11, being adjustable in height, its upper surface 12 comprising a one-piece deformable layer of carrier material 13 which is retained by means of a ring 14 and a displaceable cylinder 18 upon which the thin layer-shaped carrier material 13 is retained on the other hand, by means of an inner ring 17.

A ring part 15 of resilient (sealing) material is provided at the lower side of the retaining member 19.

During an upward movement of the cylinders 11 and 18, the deformable layer-shaped carrier material 13 carrying the coloring composition, is entrained so that the foil-like carrier material 13 comes to lie beside the raised edge 3 of the cover. Pressurized air supplied through channel 16, causes the deformable carrier material 13 to be pressed against the outer wall of the raised edge part 3. In this manner an excellent printing of the raised edge part 3 is obtained.

The space between the raised edge part 3 and the layer-shaped carrier material 13 may be evacuated through channel 20, in order to avoid during printing that air is enclosed between said raised edge part 3 and the layer-shaped carrier material 13.

Reverting to FIG. 2 the respective embodiment also permits the application of a layer-shaped carrier material 13 (not shown) between the annular plate 8 and the raised edge part 3.

While a particular embodiment of the present invention in the form of a plastic cover has been illustrated and described herein, it will be obvious that this invention is not limited thereto, but is susceptible to change in form and detail and may, for instance, also be disclosed in a tray.

What is claimed is:

1. Apparatus for printing on a plastic article having an upwardly bent portion between a flat center section and a drooping circumferential rim, said apparatus comprising:

an annular deformable carrier for carrying a coloring composition;

axially movable means, cooperating with said carrier, for bending a part of the carrier adjoining the upwardly bent portion and a part of the carrier adjoining the circumferential rim of the plastic article, said axially movable means having been adapted for embracing part of the upwardly bent portion perpendicularly of the flat center section;

wherein said axially movable means are concentrically positioned adjoining a part of the carrier which is adapted to be pressed against the top of the upwardly bent portion; and wherein said axially movable means include a first cylinder being connected to the carrier and being positioned between two concentrically positioned cylinders, said first cylinder and said two concentrically positioned cylinders being adapted for axial displacement with respect to each other in order to deform annular parts of the carrier.

2. Apparatus for printing on a plastic article having an upwardly bent portion between a flat center section and a drooping circumferential rim, said apparatus comprising:

an annular deformable carrier for carrying a coloring composition;

axially movable means, cooperating with said carrier, for bending a part of the carrier adjoining the upwardly bent portion and a part of the carrier adjoining the circumferential rim of the plastic article, said axially movable means having been adapted for embracing part of the upwardly bent portion perpendicularly of the flat center section;

wherein said axially movable means are concentrically positioned adjoining a part of the carrier which is adapted to be pressed against the top of the upwardly bent portion; and wherein said axially movable means include a first cylinder being adapted to adjoin the carrier and being positioned between two concentrically positioned members adapted for fastening down inner and outer rim areas of the carrier.

3. Apparatus according to claims 1 or 2, wherein said annular deformable carrier has a one-piece resilient deformable body.

4. Apparatus according to claims 1 or 2, wherein said annular deformable carrier is a one-piece thin flat foil.

* * * * *